US005395137A

United States Patent [19]

Kim

[11] Patent Number: 5,395,137

[45] Date of Patent: Mar. 7, 1995

[54] COLOR CODE LABEL

[76] Inventor: Hae-Woon Kim, 1-11101 Sangah Apt. 1-6, 299 Chang Dong, Dubong-Ku, Seoul, Rep. of Korea

[21] Appl. No.: 161,567

[22] Filed: Dec. 6, 1993

[30] Foreign Application Priority Data

Dec. 7, 1992 [KR] Rep. of Korea ..... 92-24581 U

[51] Int. Cl.[6] ..... B42D 15/00

[52] U.S. Cl. ..... 283/81; 283/101; 283/114; 40/630

[58] Field of Search ..... 283/81, 100, 101, 102, 283/106, 107, 108, 109, 114, 36, 38, 39, 41, 42; 40/630, 638

[56] References Cited

U.S. PATENT DOCUMENTS

| | | | |
|---|---|---|---|
| 1,868,188 | 7/1932 | Barker | 283/114 |
| 4,201,403 | 5/1980 | Turner | 283/101 |
| 4,355,824 | 10/1982 | Weber et al. | 283/39 |
| 4,422,672 | 12/1988 | Levi | 283/39 |
| 4,544,182 | 10/1985 | Spring | 283/81 |
| 4,846,503 | 7/1989 | Strauss | 283/81 |
| 5,154,448 | 10/1992 | Griffin et al. | 283/81 |
| 5,197,764 | 3/1993 | Hicinbothem et al. | 283/81 |

*Primary Examiner*—Richard K. Seidel
*Assistant Examiner*—Hwei-Siu Pater
*Attorney, Agent, or Firm*—Cushman Darby & Cushman

[57] ABSTRACT

The color code label includes a base member, a thin plate; a color code coated attached to the surface of the base member and on which color bands are arranged and printed in different colors; and a coating layer which covers the surface of the color code with opaque or semitransparent materials and is removable to expose make a desired portion of the color bands exposed, for information classification or identification. Used with any kind of information keeping structure including cords, files, binders, material cases, envelopes, jackets, the label helps users handle documents easy and fast.

13 Claims, 7 Drawing Sheets

FIG.10
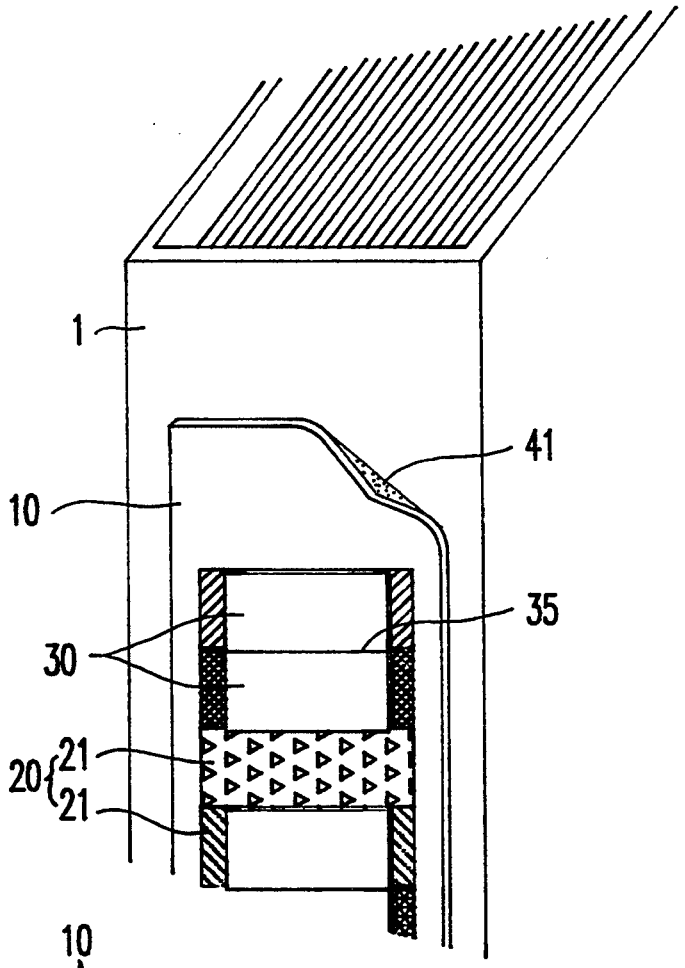
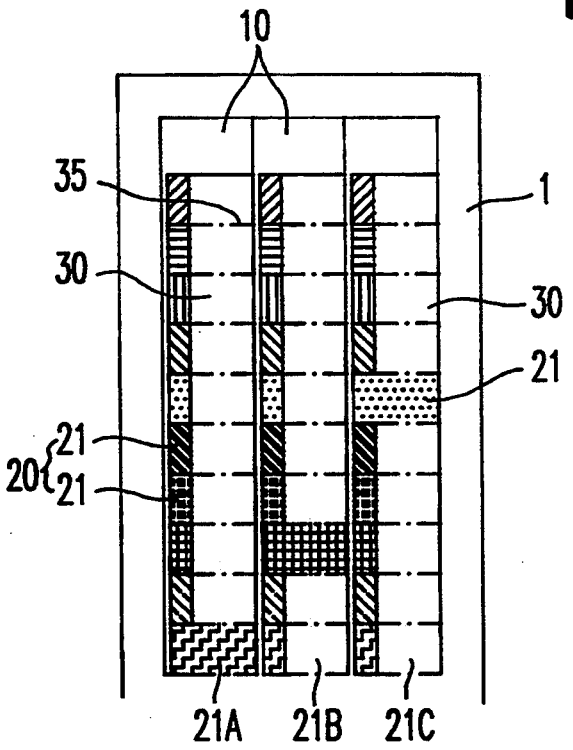
FIG.11

COLOR CODE LABEL

BACKGROUND OF THE INVENTION

FIELD OF THE INVENTION

This invention relates to a color code label with a plurality of color bands on it and covered with a partly removable coating layer.

INFORMATION DISCLOSURE STATEMENT

Generally, information materials or documents are classified and kept by using files, cards, binders etc.

Coding means for identifying or classifying contents of files or cards have been utilized in order to promptly identify the contents.

Conventional coding means have been provided by coding plates which are formed integrally on files and on which indicia such as symbols or letters are recorded, or by coding labels which can be attached on files and on which indicia such as symbols or letters are recorded.

Those coding systems have problems to manufacture the coding plates at various locations to files or to purchase the coding labels of separate item, and they increase labors and costs for the coding systems.

Another coding system has been known as a color coding system.

The color coding system uses labels of different colors to be attached on files as shown in FIG. 1.

However, the color coding system in the prior art requires a number of different color labels corresponding to the number of files.

The color coding system is not readily available because the preparation or purchase of the different color labels is sometimes very hard. If a set of color labels is provided, some labels are not used. The unused or abandoned labels are wastes of materials.

An object of the present invention is to provide a color code label to be used conveniently and efficiently for identification and classification.

Another object of the present invention is to provide a color code label to be utilized as a complex label which includes major code and one or more sub codes on a label.

Further object of the present invention is to provide a color coding system to be used easily and for various purposed by everybody including children.

Another object of the present invention is to provide a color code label with a sheet of various color bands that can be manufactured easily and economically.

SUMMARY OF THE INVENTION

The present invention comprises a thin base member; a color code which is attached to at least one surface of the base member and on which color bands are arranged and printed in various colors; and a coating layer which covers the color code opaquely or semitransparently and can be removed section by section to expose the desired color band.

BRIEF DESCRIPTION OF THE DRAWINGS

The invention will now be described by way of example with reference to the accompanying drawings in which:

FIG. 5 to 10 are perspective views of the various applications of the present invention;

FIG. 11 is a plane view of FIG. 10 with another arrangement of the attached labels;

DETAILED DESCRIPTION OF PREFERRED EMBODIMENTS

Figure 1:
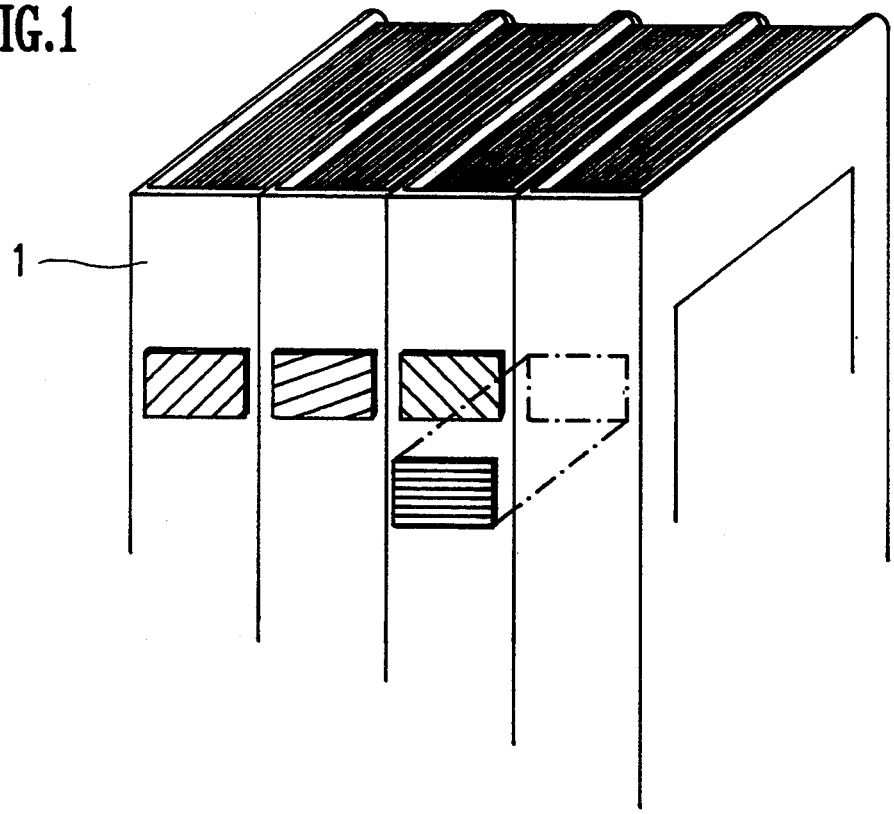
(PRIOR ART) FIG.1
FIG. 1 is perspective view showing a color coding system according to the prior art.
Figure 2:
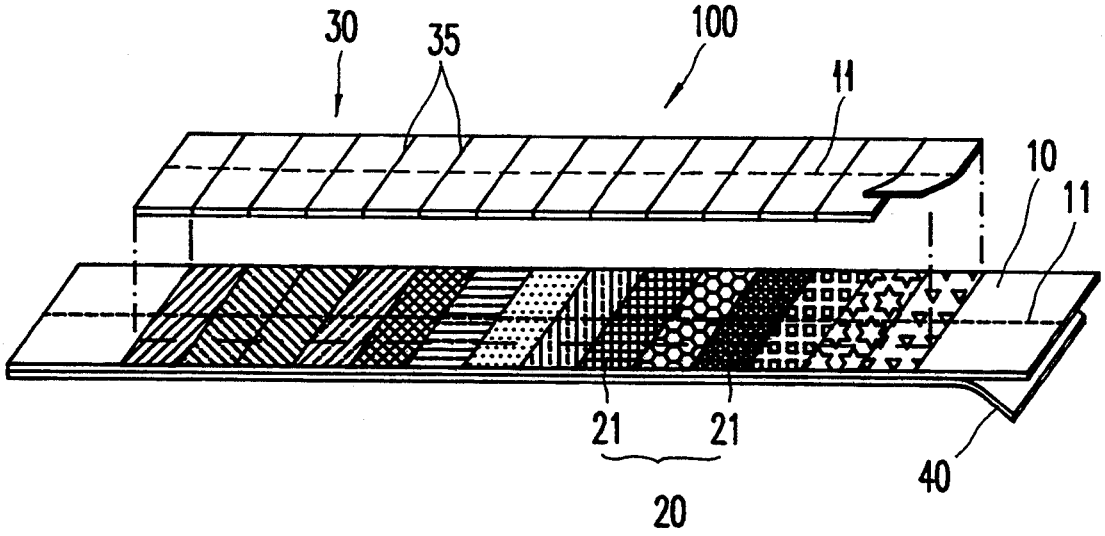
FIG. 2 is an exploded perspective view of a color code label according to the present invention.

As shown in FIG. 2, a color code label 100 of the present invention comprises a base member 10, a thin plate made of papers or plastic resins; a color code 20 printed on the surface of the base member 10 on which color bands 21 are arranged and printed in different colors; and a coating layer 30 which covers the surface of the color code 20 with opaque or semitransparent materials and has cutting-lines on positions corresponding to the boundaries of each color bands 21 so that a color band 21 can be exposed by removing a section of the coating layer.

The color code label 100 is inserted in or attached to a file, a card or a binder at a convenient place, and functions as a means of file-identification or classification.

The base member 10 is made of papers or from plastic resins in the form of a thin plate, and the configuration of the label 100 is determined according to application. The color code 20 is a family of color bands 21 which are arranged in various colors in order to identify a file by a color or color patterns.

Also, a central folding line 11 is formed on the color code 20 and a protective paper 40 is attached to the bottom of the base member 10.

The color bands 21 are of various colors and of a uniform size.

The hue and brightness of the color bands 21 is selected so clear and distinct that labeled files can be identified from distance.

The color code 20 may comprise, for example, a code with ten color bands 21 in a column or a code of two or more such columns rather than one.

When ten or less identification marks are required for a filing system, a color code with ten color bands can be used.

When more than ten identification marks are required, a color code comprising more than one such column of 10 color bands to be used.

When one hundred or less identification marks are necessary, two of the color codes 20 comprising ten color bands 21, respectively, are placed in two lanes on base member 10.

That is, each color band of an upper color code (for example, the upper color code of ten color bands 1, 2, 3, . . . 9, 10) can be paired with every color band of a lower color code (for example, the lower color code of ten color bands A, B, C, . . . I, J) one by one, for example 1-A, 1-B, . . . , 1-I, 1-J or 2-A, 2-B, . . . , 2-I, 2-J . . . or 9-A, 9-B, . . . , 9-I, 9-J, lastly, 10-A, 10-B, 10-C . . . 10-I, 10-J.

Therefore, the combination of the upper color code and the lower color code can provide one hundred different identification marks.

When three color codes 20 are placed in three lanes a thousand identification marks($10\times10\times10=1000$) can be selected. If four color codes are used in this way, ten thousand (10,000) of identification marks are provided by this system. Therefore, this system affords innumerably identification marks or subdivisions.

The present invention can be embodied as a code having uncolored parts on a side of the color code 20. Indicia such as letters, symbols, figures may be printed on the parts for subdivision of file information or the parts may be blank for user's own record.

The base member 10 can be preferably made for users' handwriting on its surface.

The coating layer 30 is semitransparent or opaque and covers the surface of the color code 20.

The coating layer 30 should be made removable so that users can make the desired color band 21 exposed by removing specific coating sections for classification or identification of files.

Figure 3:
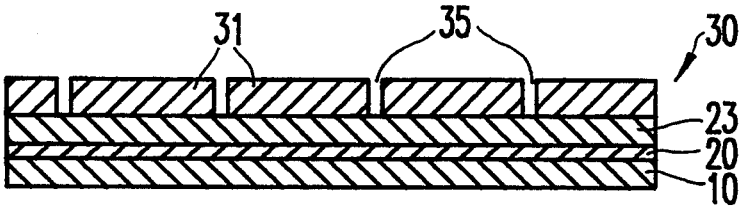
FIG. 3 and 4 are cross-sectional views of the embodiments of the present invention.
Figure 4:
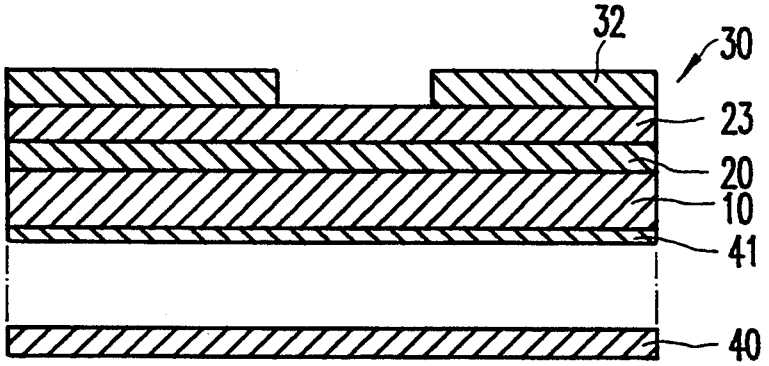

The coating layer 30 can be obtained by printing the color code with screen ink 32 which is erasable by scraping as shown in FIG. 4, or by adhering a thin plastic film or a paper sheet 31 on the surface of the color code 20 as shown in FIG. 3.

When screen ink 32 is printed as the coating layer 30, it is preferred to form a transparent plastic coating between the color code 20 and the coating layer 30 in order to protect the color bands 21 from the scraping. The screen ink 32 is supposed to be an ink of soft and dry tissues so that scraping can easily peel it off.

When the coating layer 30 is made of self-adhesive plastic film or paper sheet 31 and is attached to the color code 20, it is also desirable to form a transparent plastic coating layer 23 between the film or sheet 31 and the color code 20 in order to protect the color bands 21 from being damaged in the course of removing the film 31.

It is also desirable to set the laminating layer instead of the coating layer 23 only on the color parts, so that a user can write on the blank part of the color code. It is very hard to write something on the laminating layer 23.

It is preferable to make cutting lines 35 on the film or a paper sheet 31 so that the cutting lines 35 are on the borders of the color bands 21.

The coating layer 30 is formed to cover the color code 20 and is removable by nail or a simple tool such as coin to make a desired color band exposed for identification purpose.

If the color code 20 is entirely covered by the coating layer 30, a user may have troubles in selecting the color band 21. Therefore, it is desirable for a marginal part of the color code 20 not to be covered by the coating layer.

When letters or symbols are printed in parallel with the color bands 21 on the color code 20, the color code 20 may well be entirely with the coating layer 30.

When the coating layer 30 is semitransparent, the color bands 21 can be discerned by illumination of the colors through the coating layer 30, and again the color code 20 may well be entirely covered with the coating layer 30.

It is preferred to control the stickiness of the film type coating layer 31 so that the once-removed film 31 can be attached to the surface of the color code again. The reattachment capability can help to correct and change the identification.

The invention will now be described in more detail by showing practical applications.

EXAMPLE 1

Labels for Pocket Insertion

As shown in FIG. 5 to 8, the base member 10 is formed as a strip and the color code 20 and the coating layer 30 are formed on the strip as described above.

A pocket 2 is provided on a file or a binder and the label of the present invention is inserted into the pocket.

Figure 5:
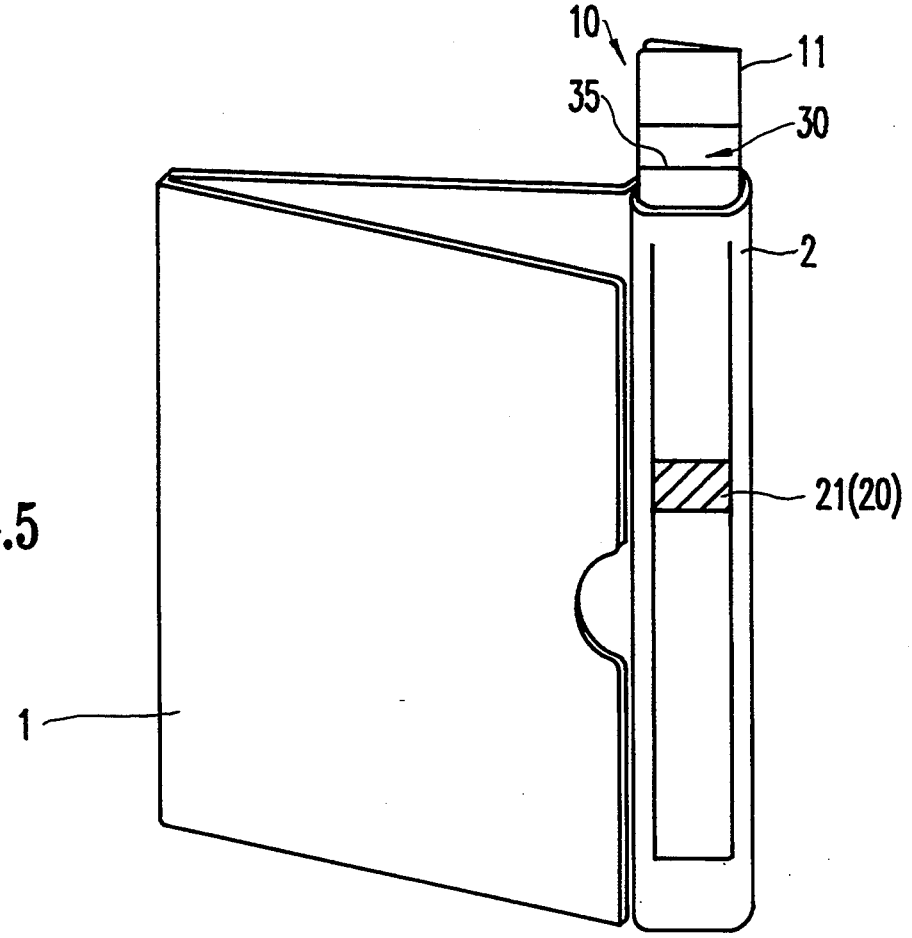

FIG. 5 shows a file 1 such as a clear holder having a pocket 2 on an extended side part of the file. For such a pocket 2, the label of the invention is longitudinally folded and inserted into the pocket 2 with the desired part of its coating layer 30 removed, while the color code 20 facing outward.

Figure 6A:
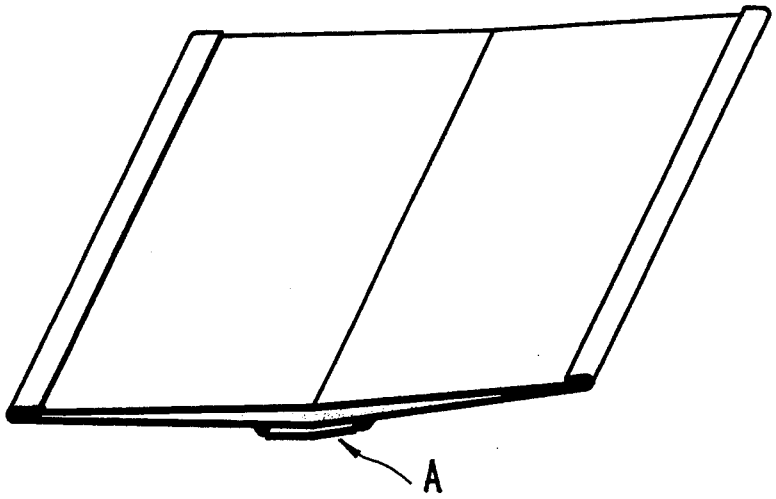
Figure 6B:
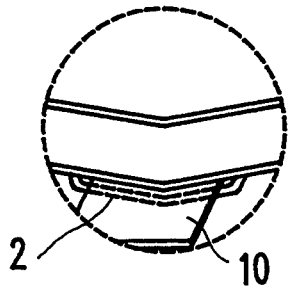

FIG. 6A shows another kind of pocket 2 which is commonly used for notebooks, books or middle-folding cards. FIG. 6B is an enlarged scale fragmentary perspective view of the region designated A in FIG. 6A. The label is inserted in such a pocket 2 with the desired portion of its coating layer removed and the color code 20 facing outward.

Figure 8:
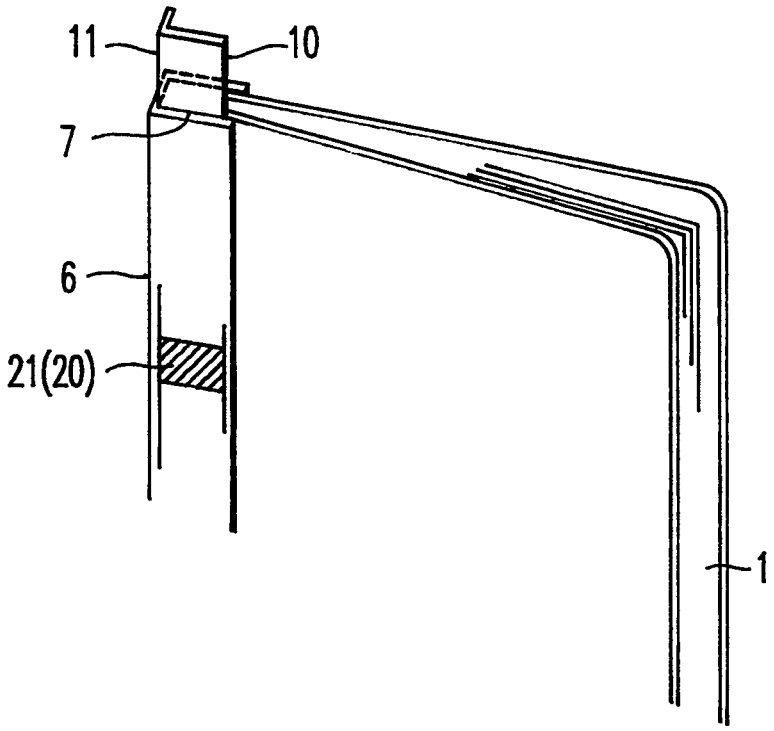

FIG. 8 shows another kind of a pocket 6 which is commonly molded on the rear end of a file 1. The label is inserted in the pocket 6 through the pocket opening 7 with the desired portion of its coating layer 30 removed and the color code 20 facing outward.

The pockets as mentioned above should be transparent.

As described above, the label of the present invention can be used with these pockets and functions as a file identification mark.

EXAMPLE 2

Labels in Use with Sticker Pockets

Figure 7:
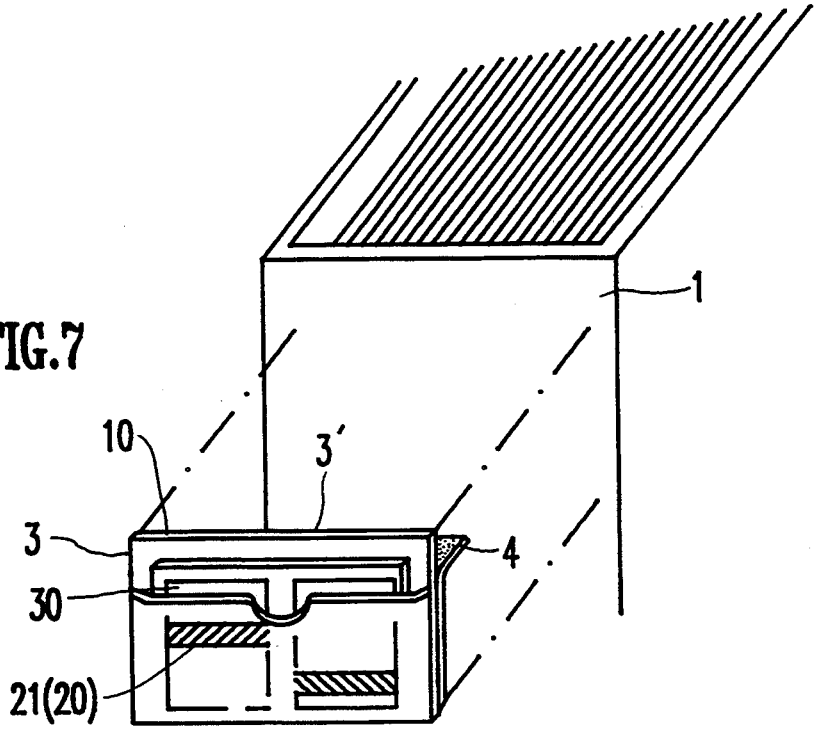

FIG. 7 shows a sticker pocket 3 and a label of the present invention. The pocket 3 has an adhesive layer on its back and a protective paper 4 is attached to the adhesive layer 31. The label is inserted in the pocket 3 and the pocket 3 is attached to desired location of a file, a binder, a card etc.

EXAMPLE 3

Labels of Self-Adhesive Type

FIG. 9 to 14 show embodiments of the present invention using an adhesive.

The rear surface of the base member 10 has an adhesive layer 41 and a protective paper 40 attached to the adhesive layer 41. When the sticker label is used the protective paper 40 is removed and the label is attached to a file, a binder, or a card to provide a file identification or classification mark.

Figure 9:
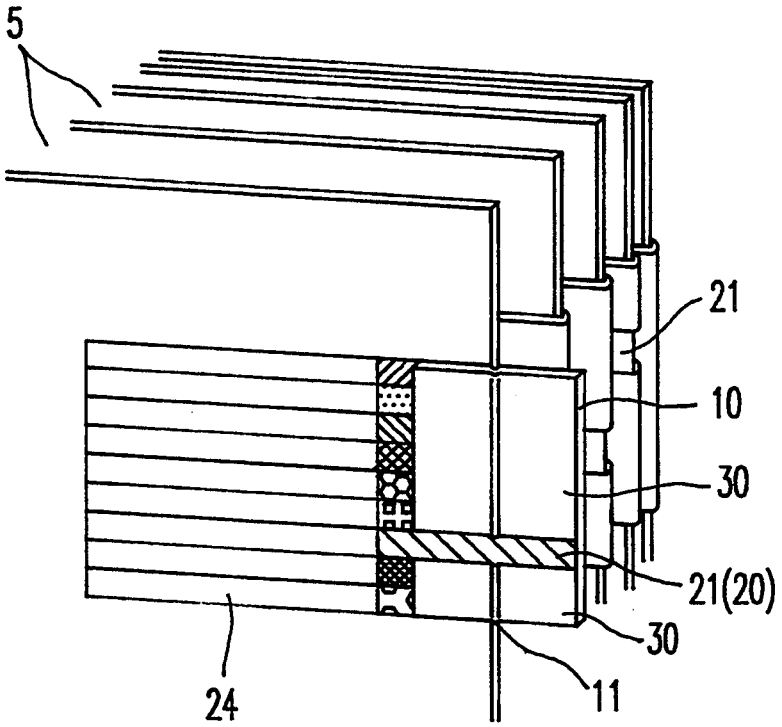

FIG. 9 shows a label with a central fold line 11 applicable to a card 5 which has records on both sides. The sticker label is attached to both sides of the card 5 after being folded and the desired portion of its coating layer removed.

FIG. 10 shows another application of the label in which labels are attached to a surface of a file. This application is useful with files, cards, envelopes etc. that have no pockets.

FIG. 11 shows another application of the sticker label, in which several sticker labels are arranged and attached to a rear end surface of a binder 1 for subsidiary identification marks.

The labels can be used for the first color code 21A to indicate major identification, while the second color code 21B and the third color code 21C indicate subsidiary identification.

Figure 12:
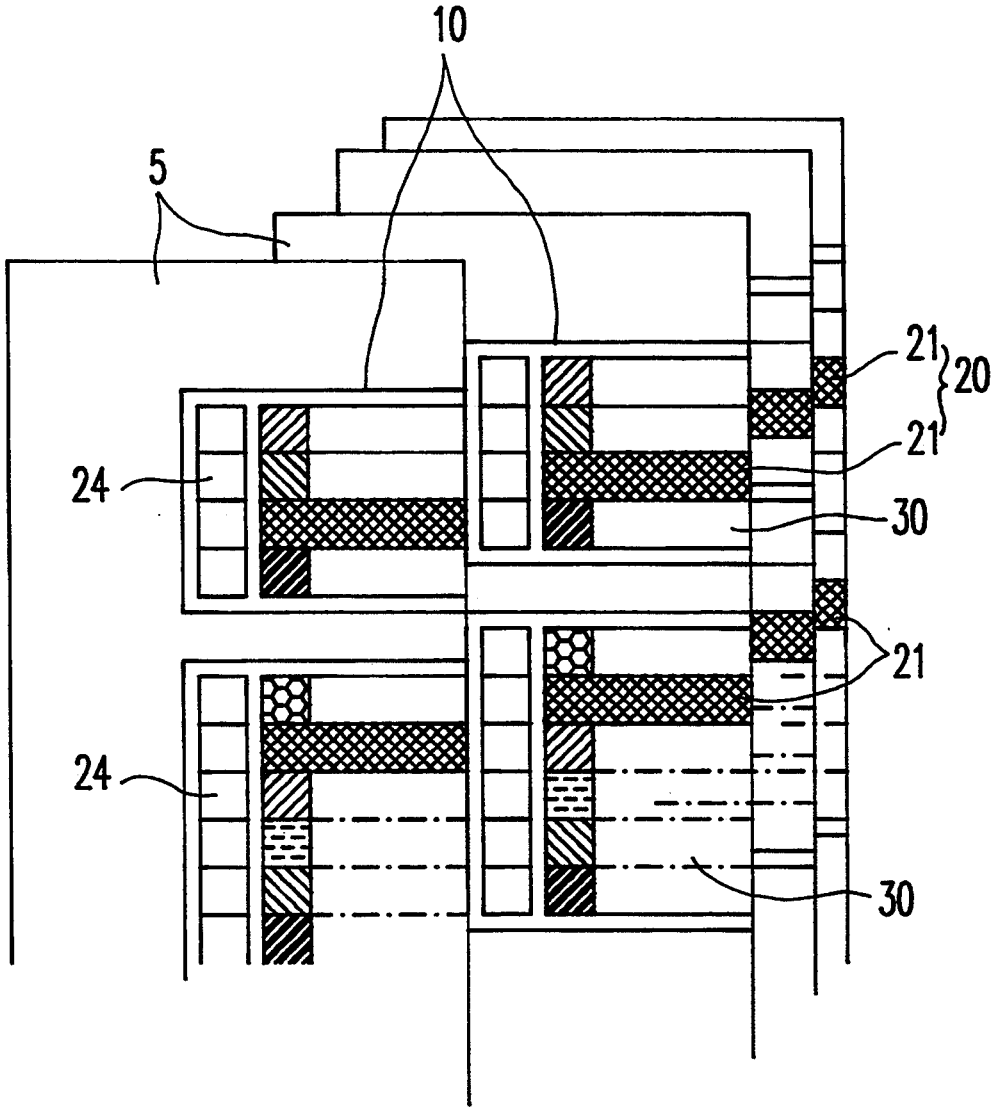
FIG. 12 is a plane view of another embodiment of the present invention on recording cards.

FIG. 12 shows a card 5, to a side of which the sticker label is attached. The label has part 24 for handwritten records on its one side for a user's own symbols or letters. The handwriting part 24 helps users identify information on the card 5.

EXAMPLE 4

Sticker Labels for End Tap

Figure 13:
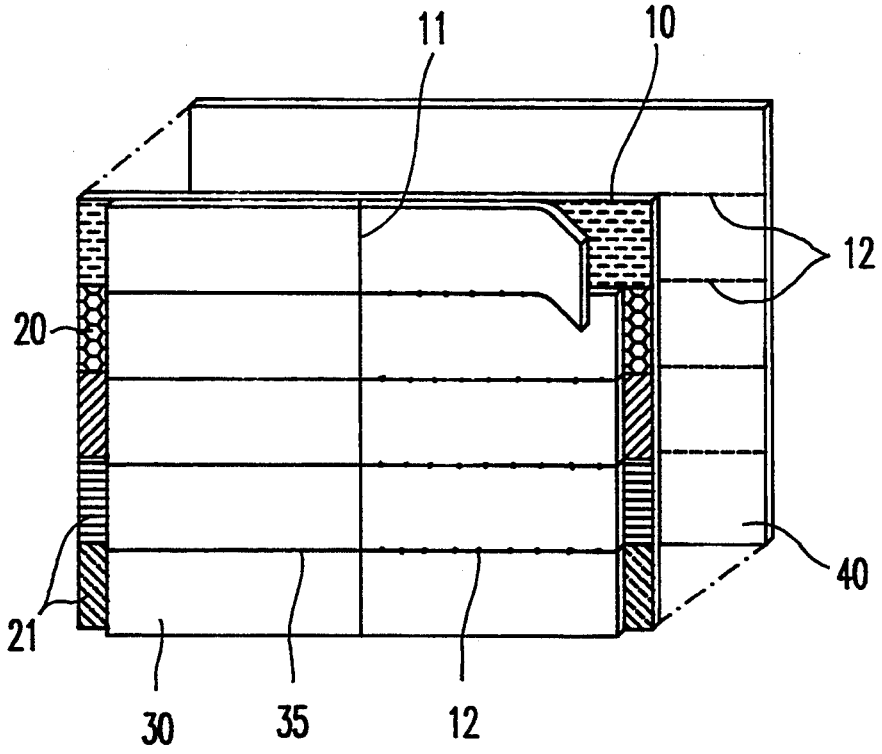
FIG. 13 is an exploded perspective view of another embodiment of the present invention to be used for index end tab.
Figure 14:
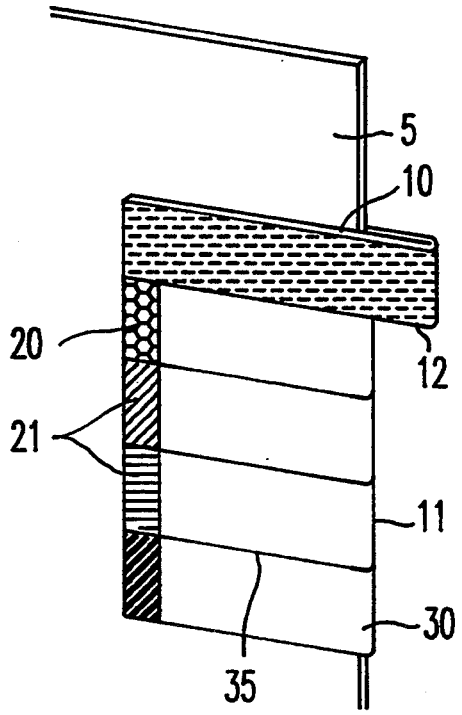
FIG. 14 is a perspective view of the attached condition of the end tab of FIG. 13.

FIG. 13 and FIG. 14 shows a sticker label which can be used as an end tap. The label has cutting lines 12 made from the coating layer 30 through the base member 10. Therefore, an end tap of a selected color can be provided protrusively by removing a coating layer 30 section to make one color band exposed and folding the exposed color band 21 for both of its back sides to be attached to each other.

The foregoing embodiments and applications are merely illustrative and other modifications are to be encompassed within the scope of the invention.

As described above, the present invention provides following merits:

Firstly, the color coded label according to the invention has innumerable applications and helps the classification or identification of files be prompt and convenient.

Secondly, the filing can be readily done under any circumstance since the color bands 21 of the color code 20 can be exposed with nail or simple tool.

Thirdly, the color code label of the invention is suitable for mass production that lowers production costs.

Fourthly, combined with additional letters and symbols, the color code can subdivide information identification or classification.

Fifthly, as it becomes an integral part of a file, a card, a binder etc., the label can reduce production costs and give its users convenience.

Sixthly, the color code label of the invention can be used for various classification or identification together with any kind of information keeping means including cards, files, binders, cases, envelopes, jackets.

What is claimed is:

1. A color code label comprising:

a base member formed of a thin plate;

a color code printed on an upper surface of the base member, said color code having a family of color bands which are arranged and printed in different colors; and a coating layer which covers an upper surface of said color code with at least partially opaque materials and can be partly removed in order to expose a desired color band of the covered color code.

2. A color code label as set forth in claim 1, further comprising an adhesive layer placed on the back of said base member and a protective paper attached to the adhesive layer.

3. A color code label as set forth in claim 2, characterized in that cutting lines are formed on the boundaries of the color bands through the base member and the coating layer so that a desired color band can be exposed as an index end tap.

4. A color code label as set forth in claim 1, characterized in that a transparent plastic coating layer is formed between said color code and said coating layer in order to protect the color bands.

5. A color code label as set forth in claim 1, characterized in that said coating layer is made of screen ink.

6. A color code label as set forth in claim 1, characterized in that said coating layer comprises a plastic film having an adhesive on its surface.

7. A color code label as set forth in claim 6, characterized in that cutting lines are made in said plastic film of the coating layer on the boundaries of the color bands.

8. A color code label as set forth in claim 1, characterized in that said coating layer comprises a paper sheet having an adhesive on its surface.

9. A color code label as set forth in claim 8, characterized in that cutting lines are made in said paper sheet of the coating layer on the boundaries of the color bands.

10. A color code label as set forth in claim 1, characterized in that a longitudinal fold line is made on the base member and the coating layer.

11. A color code label as set forth in claim 1, characterized in that the base member has blank parts beside the color code for printing such indicia.

12. A color code label as set forth in claim 1, characterized in that the coating layer does not cover the entire surface of the color code in order to expose marginal part of the color code.

13. A color code label as set forth in claim 1, characterized in that said color code comprises multi-fold color code that has a number of color codes.

* * * * *